US010837685B2

(12) United States Patent
Noor et al.

(10) Patent No.: US 10,837,685 B2
(45) Date of Patent: Nov. 17, 2020

(54) HVAC REFRIGERANT CHARGING AND RELIEVING SYSTEMS AND METHODS

(71) Applicant: Johnson Controls Technology Company, Auburn Hills, MI (US)

(72) Inventors: Aneek M. Noor, Wichita, KS (US); Jedidiah O. Bentz, Wichita, KS (US); Shaun B. Atchison, Wichita, KS (US); John W. Uerkvitz, Valley Center, KS (US); Drew H. Carlton, Wichita, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 91 days.

(21) Appl. No.: 16/044,317

(22) Filed: Jul. 24, 2018

(65) Prior Publication Data

US 2020/0003467 A1 Jan. 2, 2020

Related U.S. Application Data

(60) Provisional application No. 62/692,356, filed on Jun. 29, 2018.

(51) Int. Cl.

| | |
|---|---|
| ***F28F 9/22*** | (2006.01) |
| ***F25B 45/00*** | (2006.01) |
| ***F25B 41/04*** | (2006.01) |

(52) U.S. Cl.

CPC ..... *F25B 45/00* (2013.01); *F25B 41/04* (2013.01); *F25B 2345/001* (2013.01);
(Continued)

(58) Field of Classification Search

CPC .... F25B 45/00; F25B 41/04; F25B 2345/001; F25B 2345/002; F25B 2500/23; F25B 2500/24; F25B 2700/04; F25B 2700/21
(Continued)

(56) References Cited

U.S. PATENT DOCUMENTS 3,785,163 A * 1/1974 Wagner ..... F17C 6/00 62/77
3,875,755 A * 4/1975 Anderson ..... F25B 45/00 62/77

(Continued)

FOREIGN PATENT DOCUMENTS

CN 202835964 3/2013
CN 106016868 10/2016

(Continued)

*Primary Examiner* — Claire E Rojohn, III
(74) *Attorney, Agent, or Firm* — Fletcher Yoder, P.C.

(57) ABSTRACT

A heating, ventilation, and air conditioning system may include a refrigerant loop to circulate refrigerant, a first valve, a second valve, a sensor to measure parameters of the refrigerant, a refrigerant tank fluidly coupled to the refrigerant loop via the valves, and control circuitry communicatively coupled to the sensor, the first valve, and the second valve. The control circuitry may determine environmental conditions and detect whether an undercharge or overcharge condition is present in the refrigerant loop based at least in part on the environmental conditions and the measured parameters. The control circuitry may also instruct the first valve to open when the undercharge condition is detected to facilitate flowing refrigerant from the refrigerant tank into the refrigerant loop and instruct the second valve to open when the overcharge condition is detected to facilitate flowing refrigerant from the refrigerant loop into the refrigerant tank.

14 Claims, 8 Drawing Sheets

(52) U.S. Cl.
CPC ..... *F25B 2345/002* (2013.01); *F25B 2500/23* (2013.01); *F25B 2500/24* (2013.01); *F25B 2700/04* (2013.01); *F25B 2700/21* (2013.01)

(58) Field of Classification Search
USPC ..... 165/149
See application file for complete search history.

(56) References Cited

U.S. PATENT DOCUMENTS 3,903,709 A * 9/1975 Anderson ..... F25B 45/00 62/77
4,226,606 A * 10/1980 Yaeger ..... F24D 17/02 62/238.6
4,319,459 A * 3/1982 Hannett ..... F25B 45/00 62/292
4,856,288 A * 8/1989 Weber ..... B60H 1/00585 62/129
5,381,669 A * 1/1995 Bahel ..... F25B 49/005 62/129
6,065,298 A * 5/2000 Fujimoto ..... F25B 49/025 62/230
6,324,854 B1 * 12/2001 Jayanth ..... F25B 49/005 62/127
6,463,747 B1 * 10/2002 Temple ..... F25B 49/005 62/129
6,571,566 B1 * 6/2003 Temple ..... F25B 49/005 62/127
7,472,557 B2 * 1/2009 Kang ..... F25B 45/00 62/127
7,500,368 B2 * 3/2009 Mowris ..... F25B 49/005 62/149
7,980,086 B2 * 7/2011 Kotani ..... F25B 45/00 62/149
8,402,779 B2 * 3/2013 Nishimura ..... F25B 13/00 62/149
8,919,139 B2 * 12/2014 Yamada ..... F25B 49/005 62/129
9,310,094 B2 * 4/2016 Kates ..... G06F 17/10
9,759,465 B2 * 9/2017 Schuster ..... F25B 45/00
9,874,384 B2 * 1/2018 Connell ..... F25B 49/02
10,605,469 B2 * 3/2020 McCune ..... F24F 1/56
2003/0182950 A1 * 10/2003 Mei ..... F25B 49/005 62/129
2005/0241334 A1 * 11/2005 Taras ..... F25B 41/04 62/513
2006/0059925 A1 * 3/2006 Horan ..... F25B 49/005 62/129
2006/0118362 A1 * 6/2006 Brown ..... B60H 1/00585 184/1.5
2006/0137367 A1 * 6/2006 Galante ..... F25B 45/00 62/149
2006/0137368 A1 * 6/2006 Kang ..... G01K 1/02 62/149
2007/0163276 A1 * 7/2007 Braun ..... F25B 49/005 62/149
2007/0295018 A1 * 12/2007 Williams ..... F25B 29/003 62/238.6
2010/0088046 A1 * 4/2010 Schuster ..... F25B 49/005 702/50
2010/0089076 A1 * 4/2010 Schuster ..... F25B 49/005 62/77
2011/0308267 A1 * 12/2011 Tamaki ..... F25B 45/00 62/222
2012/0041608 A1 * 2/2012 Zugibe ..... G01N 25/18 700/285
2014/0260342 A1 * 9/2014 Pham ..... F25B 45/00 62/56
2014/0299289 A1 * 10/2014 Alsaleem ..... F24D 19/1087 165/11.1
2015/0026795 A1 * 1/2015 Fleysher ..... G06F 21/31 726/19
2015/0059367 A1 * 3/2015 Emo ..... F25B 45/00 62/77
2016/0047584 A1 * 2/2016 Bahel ..... F25B 49/005 62/115
2017/0336113 A1 * 11/2017 Walden ..... F25B 41/04
2018/0010833 A1 * 1/2018 Sibik ..... F25D 1/00
2018/0031253 A1 * 2/2018 McCune ..... F25B 5/02
2019/0353388 A1 * 11/2019 Burns ..... F24F 3/0527
2020/0003467 A1 * 1/2020 Noor ..... F25B 45/00

FOREIGN PATENT DOCUMENTS

EP 3216636 8/2017
EP 3246640 8/2017
JP 2014016138 1/2014
KR 2015137878 4/2017

* cited by examiner

HVAC REFRIGERANT CHARGING AND RELIEVING SYSTEMS AND METHODS

CROSS REFERENCE TO RELATED APPLICATIONS

This application claims priority from and the benefit of U.S. Provisional Application Ser. No. 62/692,356, entitled "HVAC REFRIGERANT CHARGING AND RELIEVING SYSTEMS AND METHODS," filed Jun. 29, 2018, which is hereby incorporated by reference in its entirety for all purposes.

BACKGROUND

The present disclosure generally relates to heating, ventilation, and air conditioning (HVAC) systems and, more particularly, to a refrigerant charging and relieving system incorporated within an HVAC system.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

An HVAC system generally includes a refrigerant in a looped system to facilitate heat transfer to or from a desired location. Generally, the refrigerant is pressurized in one section of the loop and expanded in another. In many systems, the refrigerant may change state (e.g., condense or evaporate) during such pressurization or expansion and/or during subsequent cooling or heating. Furthermore, the system may be designed for the refrigerant to be at a particular state at particular points in the loop. However, the amount of refrigerant in the system may affect the operating temperatures and pressures of the refrigerant. As such an overcharge or undercharge of the refrigerant level may cause the refrigerant to be in an undesirable state (e.g., temperature and/or pressure) at certain points in the loop.

SUMMARY

This section provides a brief summary of certain embodiments described in the present disclosure to facilitate a better understanding of the present disclosure. Accordingly, it should be understood that this section should be read in this light and not to limit the scope of the present disclosure. Indeed, the present disclosure may encompass a variety of aspects not summarized in this section.

The present disclosure relates to a heating, ventilation, and air conditioning system including a refrigerant loop to circulate refrigerant, a first valve, a second valve, one or more sensors to measure parameters of the refrigerant, a refrigerant tank fluidly coupled to the refrigerant loop via the valves, and control circuitry communicatively coupled to the one or more sensors, the first valve, and the second valve. The control circuitry may determine environmental conditions and detect whether an undercharge or overcharge condition is present in the refrigerant loop based at least in part on the environmental conditions and the measured parameters. The control circuitry may also instruct the first valve to open when the undercharge condition is detected to facilitate flowing refrigerant from the refrigerant tank into the refrigerant loop and instruct the second valve to open when the overcharge condition is detected to facilitate flowing refrigerant from the refrigerant loop into the refrigerant tank.

The present disclosure also relates to a method comprising including determining, via control circuitry, an expected superheat parameter, an expected subcool parameter, or both, wherein the expected superheat parameter and the expected subcool parameter correspond to an optimal charge level for a refrigerant loop of a heating or air conditioning system. The method may also include determining, via the control circuitry, at least one of an actual superheat parameter value and an actual subcool parameter value and determining an undercharge condition or an overcharge condition of the refrigerant loop based at least in part on the comparison of the expected superheat parameter and the actual superheat parameter value, the comparison of the expected subcool parameter and the actual subcool parameter value, or both. Additionally, the method may include opening, a valve operatively coupling the refrigerant loop to a refrigerant tank to optimize a charge level of a refrigerant in response to determining the refrigerant loop is in the undercharge condition or the overcharge condition.

The present disclosure also relates to a system including a refrigerant tank operatively coupled to a refrigerant loop, wherein the refrigerant loop circulates a refrigerant. The system may also include a valve to operatively couple the refrigerant tank to the refrigerant loop and multiple sensors to measure at least one environmental temperature, at least one refrigerant temperature, and at least one refrigerant pressure. The system may also include control circuitry to calculate a current superheat value and a current subcool value based at least in part on the at least one refrigerant temperature and the at least one refrigerant pressure. The control circuitry may also calculate a superheat reference value and a subcool reference value based at least in part on the at least one environmental temperature and perform a comparison between the current superheat value and the superheat reference value and the current subcool value and the reference subcool value. Additionally, the control circuitry may also determine if an undercharge condition currently exists in the refrigerant loop based at least in part on the comparison and facilitate opening and closing of the valve in response to the undercharge condition to regulate adding additional refrigerant from the refrigerant loop until an optimal refrigerant level is achieved.

BRIEF DESCRIPTION OF THE DRAWINGS

Various aspects of the present disclosure may be better understood upon reading the detailed description and upon reference to the drawings, in which.

DETAILED DESCRIPTION

Figure 1:
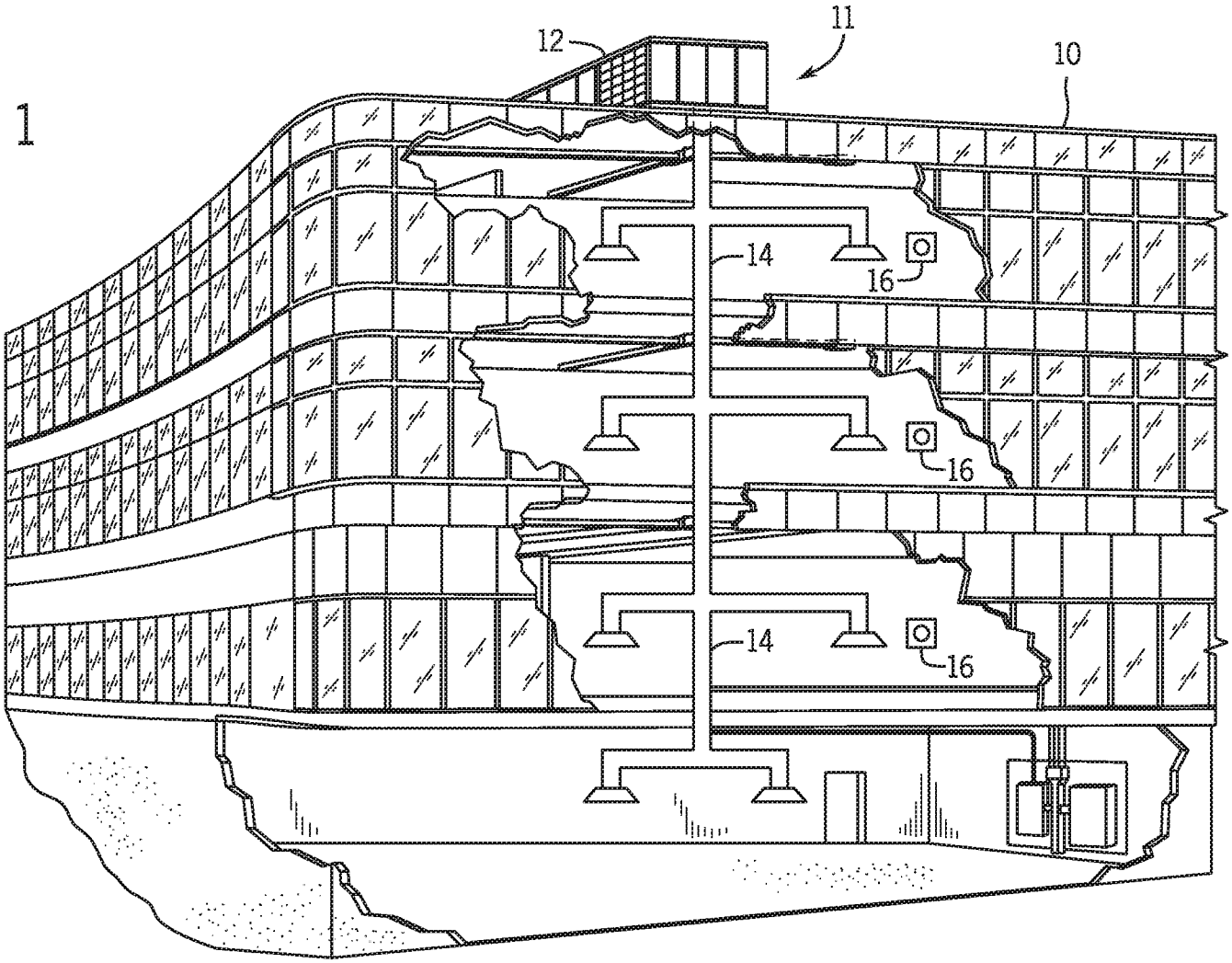
FIG. 1 is a partial cross-sectional view of a building that includes a heating, ventilating, and air conditioning (HVAC), in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As will be discussed in further detail below, heating, ventilation, and air conditioning (HVAC) systems (e.g., air conditioners and/or heat pumps) generally include a refrigerant in a looped system to facilitate heat transfer to or from a desired location. Generally, the refrigerant is pressurized in one section of the loop and expanded in another. In some embodiments, the refrigerant may change state (e.g., gas to liquid or liquid to gas) during such pressurization, expansion, or when heat is transferred to or from the refrigerant (e.g., via a heat exchanger). For example, the refrigerant may be compressed via a compressor to a higher pressure, and, in turn may change from a vapor state to a liquid state. Additionally or alternatively, a refrigerant under high-pressure may be cooled, for example by a heat exchanger (e.g., condenser coils) to change from a vapor state to a liquid state. Other elements of the HVAC system may perform complementary actions such as expansion of or heat transfer to the refrigerant to change its state between a liquid state and a gaseous (e.g., vapor) state.

In some embodiments, certain aspects of the HVAC system may be designed for the refrigerant to be in a particular state at a particular point in the loop. For example, some compressors may operate more efficiently if the input refrigerant is in a gaseous state. Furthermore, some compressors may have a reduced lifespan if the incoming refrigerant is in a liquid state, for example, from higher induced stresses due to liquids being generally less compressible than gas. Additionally, techniques for expansion of the refrigerant, for example using an expansion valve, may be more efficient when the incoming refrigerant is in a liquid state. As such, maintaining the refrigerant at the desired state may facilitate optimizing operation of the HVAC system. However, the amount of refrigerant in the system may affect the operating temperatures and pressures. As such an overcharge or undercharge of the refrigerant level may cause the refrigerant to be in an undesirable state or at an undesirable temperature and/or pressure at certain points in the loop.

Additionally, the optimal amount of refrigerant in the loop may vary depending on the mode of operation of the HVAC system (e.g., air conditioner mode or heat pump mode) and the ambient temperatures in which the system is operating, for example, by altering the effectiveness of the system's heat exchangers. Accordingly, in some embodiments, refrigerant may be added or removed from the system to maintain an optimal refrigerant level. Furthermore, a break in the loop (e.g., leak) may be supplemented to continue optimal operation until such a break may be repaired, which, at least in some instances, may facilitate improving operational reliability and/or reducing operational downtime.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

To help illustrate, a building 10 serviced by a heating, ventilating, and air conditioning (HVAC) system 11 is shown in FIG. 1. In some embodiments, the building 10 may be a commercial structure or a residential structure. Additionally, the HVAC system 11 may include equipment, such as one or more HVAC units 12 and/or one or more furnaces, that operates to produce temperature-controlled air, which may be supplied to internal spaces within the building via ductwork 14. As shown, the HVAC unit 12 is disposed on the roof of the building 10; however, the HVAC unit 12 may be located in other equipment rooms or areas adjacent the building 10.

To facilitate controlling operation of the HVAC equipment, the HVAC system 11 may include a control system. In some embodiments, the control system may be implemented using one or more control devices 16, such as a thermostat, a zone sensor, a zone control panel, a pressure transducer, and/or a temperature transducer. For example, a control device 16 may be a thermostat used to designate target air conditions, such as target temperature and/or target humidity level, within the building 10 and/or that measures air conditions present within the building 10.

To facilitate achieving the target air conditions, the control system may control operation of the HVAC unit 12 and/or other HVAC equipment, such as fans or air dampers disposed in the ductwork 14, based at least in part on the target air conditions and measured air conditions. For example, when the difference between the measured temperature and the target temperature is greater than a threshold, the control system may turn on or run the HVAC unit 12 to circulate refrigerant through one or more heat exchangers to facilitate producing temperature-controlled air. Additionally, the control system may turn on a fan and/or adjust position of an air damper to facilitate supplying the temperature-controlled air to internal spaces within the building 10 via the ductwork 14.

To facilitate producing temperature-controlled air, in some embodiments, the HVAC unit 12 may be selectively operated in different modes, such as a first-stage cooling mode, a second-stage cooling mode, a fan only mode, a first-stage heating mode, and a second-stage heating mode. For example, when operating in a heating mode or heat pump mode, the HVAC unit 12 may inject heat to produce heated air, which may then be supplied to internal spaces within the building 10. Additionally or alternatively, the HVAC system 11 may include a furnace that operates to produce the heated air. Furthermore, when operating in a cooling mode or air conditioning mode, the HVAC unit 12 may extract heat to produce cooled air, which may then be supplied to internal spaces within the building 10.

In some embodiments, the HVAC system 11 may be a split HVAC system, for example, which includes an outdoor HVAC unit and an indoor HVAC unit. Additionally or alternatively, an HVAC unit 12 may be a single package unit that includes other equipment, such as a blower, a fan, an integrated air handler, and/or an auxiliary heating unit. For example, in the depicted embodiment, the HVAC unit 12 is a rooftop unit (RTU) that conditions a supply air stream, such as environmental air and/or a return air flow from the building 10.

Figure 2:
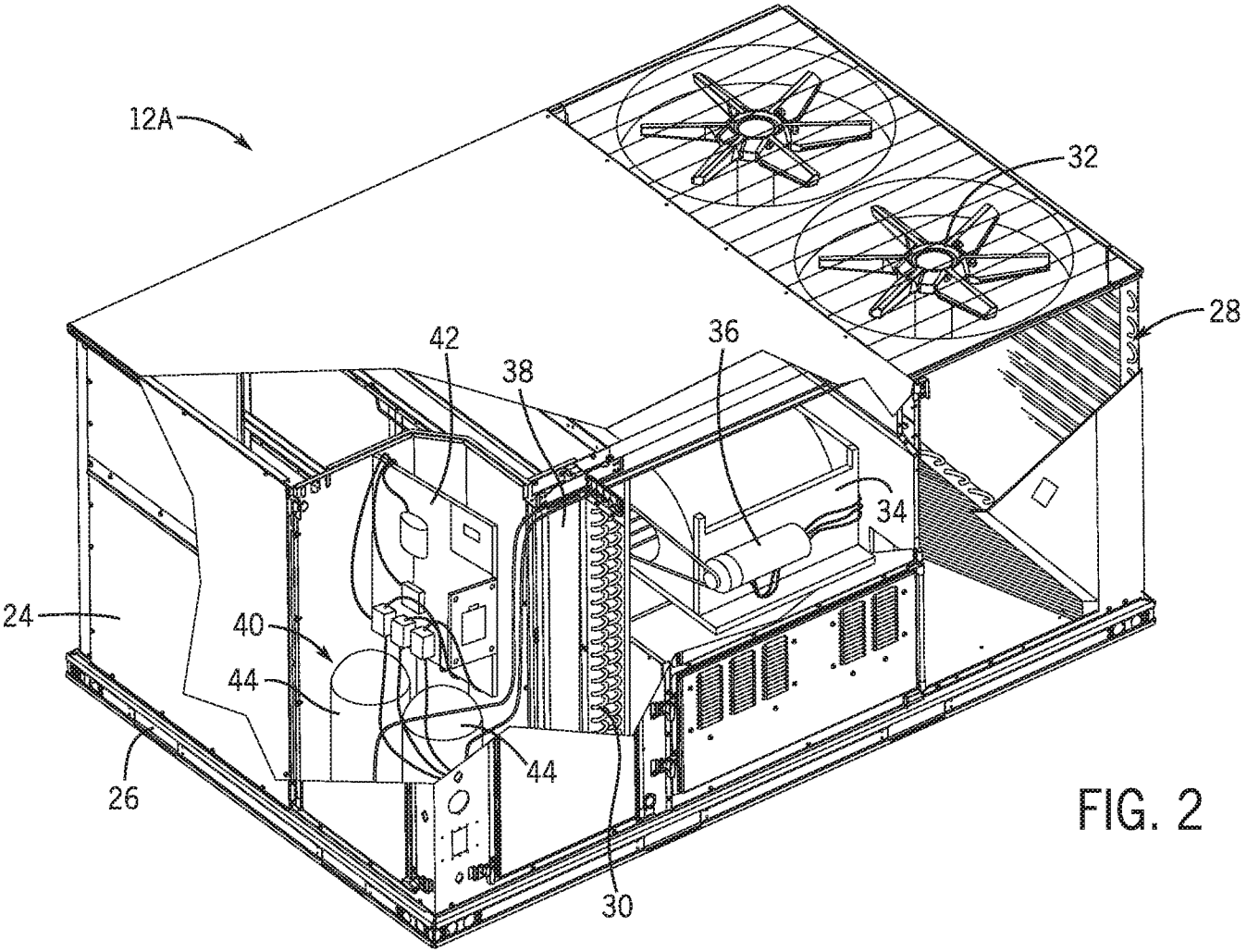
FIG. 2 is a partial cross-sectional view of an HVAC unit that may be included in the HVAC system of FIG. 1, in accordance with an embodiment of the present disclosure.

To help illustrate, an example of a single package HVAC unit 12A is shown in FIG. 2. As depicted, the HVAC unit 12A includes a housing 24, rails 26, an environment heat exchanger 28, an supply air heat exchanger 30, one or more fans 32, a blower assembly 34, a motor 36, one or more filters 38, a compressor 40, and a control board 42, which may be communicatively coupled to or included in the HVAC control system. In some embodiments, the housing 24 may enclose the HVAC unit 12 to provide structural support and/or to protect to internal components from environmental and/or other contaminants. Additionally, in some embodiments, the housing 24 may be constructed of galvanized steel and insulated with aluminum foil faced insulation.

Furthermore, as in the depicted embodiment, rails 26 may be joined to the bottom perimeter of the housing 24 to provide a foundation for the HVAC unit 12A. For example, the rails 26 may provide access for a forklift and/or overhead rigging to install and/or remove the HVAC unit 12. Additionally, in some embodiments, the rails 26 may fit into "curbs," for example, implemented on the roof of the building 10 to enable the HVAC unit 12 to provide air to the ductwork 14 while blocking contaminants, such as rain, from leaking into the building 10.

As will be described in more detail below, the environment heat exchanger 28 and the supply air heat exchanger 30 may be included in a refrigerant circuit (e.g., loop) that operates to circulate refrigerant, such as R-410A. In particular, the environment heat exchanger 28 and the supply air heat exchanger 30 may each include tubing through which the refrigerant is circulated to facilitate heat exchange between the refrigerant and air. In some embodiments, the tubing may include multichannel tubing, copper tubing, aluminum tubing, and/or the like.

In other words, the environment heat exchanger 28 and the supply air heat exchanger 30 may implement a thermal cycle in which the refrigerant undergoes phase changes and/or temperature changes as it flows through the environment heat exchanger 28 and the supply air heat exchanger 30 to produce heated air and/or cooled air. For example, when operating in a cooling mode, the environment heat exchanger 28 may function as a condenser to extract heat from the refrigerant and the supply air heat exchanger 30 may function as an evaporator to use the refrigerant to extract heat from the air to be supplied to internal spaces within the building 10. On the other hand, when operating in a heating mode, the environment heat exchanger 28 may function as an evaporator to inject heat into the refrigerant and the supply air heat exchanger 30 may function as a condenser to inject heat from the refrigerant into the air to be supplied to internal spaces within the building 10.

To facilitate heat exchange, during operation, the fans 32 may draw environmental or outside air through the environment heat exchanger 28. In this manner, the environmental air may be used to heat and/or cool as the refrigerant as it flows through the tubing of the environment heat exchanger 28. Additionally, a blower assembly 34, powered by a motor 36, may draw air to be supplied to internal portions of the building 10 through the supply air heat exchanger 30. In some embodiments, the supply air may include environmental air, outside air, return air, inside air, or any combination thereof. In any case, in this manner, the refrigerant may be used to heat and/or cool the supply air as it flows through the tubing of the supply air heat exchanger 30.

In some embodiments, the HVAC unit 12 may flow supply air through one or more air filters 38 that remove particulates and/or other air contaminants from the supply air. For example, one or more air filters 38 may be disposed on an air intake side of the supply air heat exchanger 30 to reduce likelihood of contaminants contacting tubing of the supply air heat exchanger 30. Additionally or alternatively, one or more air filters 38 may be disposed on an air output side of the HVAC unit 12A to reduce likelihood of contaminants being supplied to internal spaces within the building 10.

The HVAC unit 12 also may include other HVAC equipment, such as a compressor 40, a solid-core filter drier, a drain pan, a disconnect switch, an economizer, pressure switches, and/or the like. In some embodiments, the compressor 40 may be a scroll compressor, a rotary compressor, a screw compressor, or a reciprocating compressor. Additionally, in some embodiments, the compressor 40 may be implemented using multiple selectable compressor stages 44. For example, in the depicted embodiment, the compressor 40 is implemented in a dual stage configuration with two compressor stages 44.

In this manner, an HVAC system 11 may be implemented with one or more single package HVAC units 12A. As described above, in other embodiments, an HVAC system 11 may be a split HVAC system. In such embodiments, instead of a single package HVAC unit 12A, the HVAC system 11 may be implemented with split HVAC units, such as an outdoor HVAC unit and an indoor HVAC unit.

Figure 3:
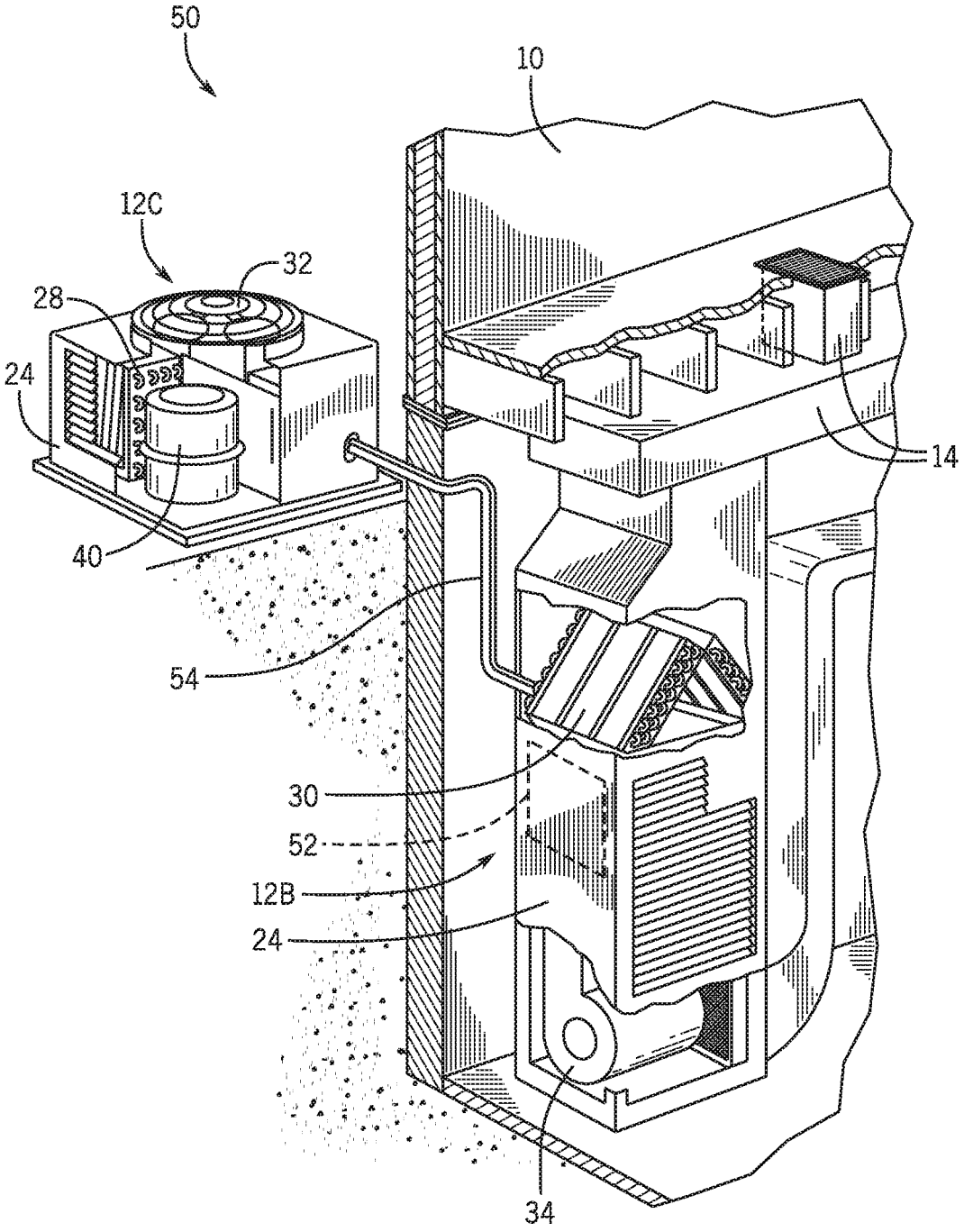
FIG. 3 is a partial cross-sectional view of an outdoor HVAC unit and an indoor HVAC unit that may be included in the HVAC system of FIG. 1, in accordance with an embodiment of the present disclosure.

To help illustrate, an example of a portion 50 of an HVAC system 11, which includes an indoor HVAC unit 12B and an outdoor HVAC unit 12C, is shown in FIG. 3. As depicted, the outdoor HVAC unit 12C may be implemented outside of the building 10, for example, adjacent a side of the building 10 and covered by a shroud or housing 24 to protect the system components from debris and/or other contaminants. On the other hand, the indoor HVAC unit 12B may be implemented inside the building 10, for example, in a utility room, an attic, a basement, or the like.

Additionally, as depicted, the outdoor HVAC unit 12C includes an environment heat exchanger 28 and a fan 32. As discussed above, in some embodiments, the environment heat exchanger 28 may function as a condenser when in a cooling mode and as an evaporator when in a heating mode.

Furthermore, as depicted, the indoor HVAC unit 12B includes a supply air heat exchanger 30 and a blower assembly 34. In some embodiments, the indoor HVAC unit 12B may also include a furnace 52, for example, when HVAC system 11 is not implemented to operate in a heat pump mode. In such embodiments, the furnace 52 may combust fuel, such as natural gas, to produce a combustion product, which may be flowed through tubing of a separate heat exchanger to facilitate injecting heat from the combustion product into supply air to be routed through ductwork 14 of the building 10.

In some embodiments, the supply air heat exchanger 30 may function as an evaporator when in a cooling mode and as a condenser when in a heating mode. Thus, as depicted, the indoor HVAC unit 12B and the outdoor HVAC unit 12C may be fluidly coupled via one or more refrigerant conduits 54 to form a refrigerant circuit (e.g., loop), for example, typically transferring primarily liquid refrigerant in one direction and primarily vaporized refrigerant in the opposite direction.

Figure 4:
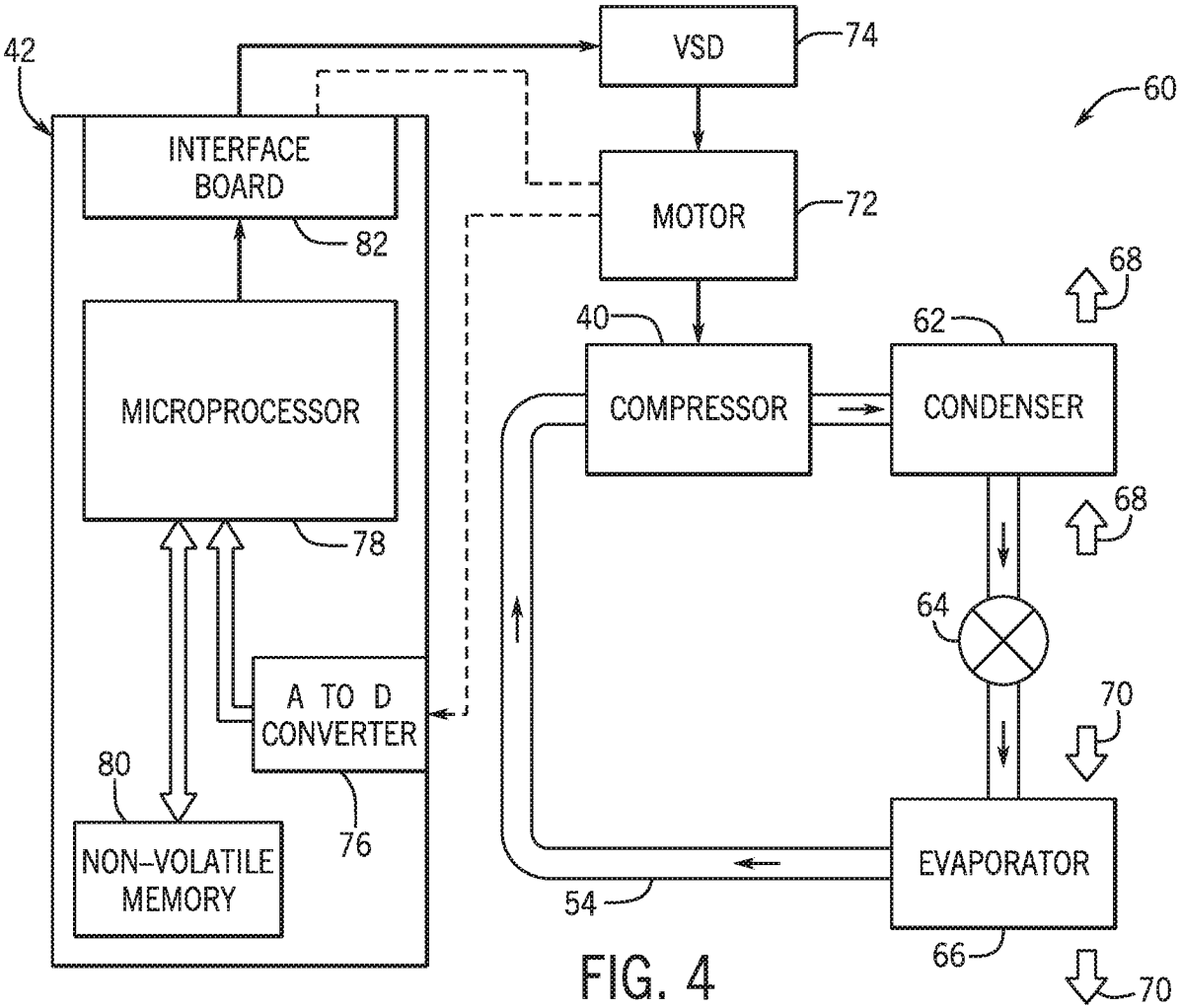
FIG. 4 is a block diagram of a refrigerant loop that may be implemented in the HVAC system of FIG. 1, in accordance with an embodiment of the present disclosure.

To help illustrate, an example schematic of a portion 60 of an HVAC unit 12 is shown in FIG. 4. As depicted, the HVAC unit 12 includes a compressor 40, a condenser 62, one or more expansion devices 64 or valves, and an evaporator 66. As described above, the condenser 62 and/or the evaporator 66 may each be implemented using one or more heat exchangers. In any case, actuation of the compressor 40 generally drives circulation of refrigerant through the refrigerant conduits 54. In particular, the compressor 40 may receive refrigerant vapor from the evaporator 66, compress the refrigerant vapor, and output the compressed refrigerant vapor to the condenser 62.

As the refrigerant flows through the condenser 62, a first air flow 68 may be used to extract heat from refrigerant to facilitate condensing the vapor into liquid. When operating in a cooling mode, the first air flow 68 may be produced using environmental or outside air, for example, by actuating a fan 32. On the other hand, when operating in a heating mode, the first air flow 68 may be produced using supply air, for example, by actuating a blower assembly 34. Before being supplied to the evaporator 66, the refrigerant may flow through one or more expansion devices 64 to facilitate reducing pressure.

As the refrigerant flows through the evaporator 66, the refrigerant may undergo a phase change from liquid to vapor that facilitates extracting heat from a second air flow 70. When operating in a cooling mode, the second air flow 70 may be produced using supply air, for example, by actuating a blower assembly 34. On the other hand, when operating in a heating mode, the second air flow 70 may be produced using environmental or outside air, for example, by actuating a fan 32. Thereafter, the refrigerant may be circulated back to the compressor 40.

As depicted, the compressor 40 may be actuated by a motor 72 during operation. In some embodiments, the motor 72 may be a switched reluctance motor, an induction motor, an electronically commutated permanent magnet motor, and/or another suitable electromechanical motor. In other words, the motor 72 may actuate the compressor 40 when electrical power is supplied to the motor 72.

To facilitate controlling supply of electrical power to the motor 72, a variable speed drive (VSD) 74 and/or a control board 42 may be coupled to the motor 72. In particular, the variable speed drive 74 may receive alternating current (AC) electrical power having a fixed line voltage and a fixed line frequency from a power source, such as an electrical grid. Additionally, the control board 42 may control operation of the variable speed drive 74 to supply alternating current (AC) electrical power with a variable voltage and/or a variable frequency to the motor 72, for example, by controlling switching devices implemented in the variable speed drive 74. In other embodiments, the motor 72 may be powered directly from an AC power source or a direct current (DC) power source, such as a battery.

To facilitate controlling operation of the variable speed drive 74 or motor 72, as in the depicted embodiment, the control board 42 may include an analog to digital (A/D) converter 76, a microprocessor 78, non-volatile memory 80, and an interface 82. For example, to control switching in the variable speed drive 74, the microprocessor 78 may execute instructions stored in a tangible, non-transistor, computer readable medium, such as the non-volatile memory 80, to determine control signals or commands, which may be communicated to the variable speed drive 74 via the interface 82. Additionally, the control board 42 may control switching in the variable speed drive 74 based at least in part on feedback from the motor 72 and/or other sensors, for example, as analog electrical signals, which may be converted to digital data via the analog to digital (A/D) converter 76 before processing by the microprocessor 78.

In any case, it should be appreciated that any of the features described herein may be incorporated with the HVAC unit 12, a residential heating and cooling system, or other HVAC system. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
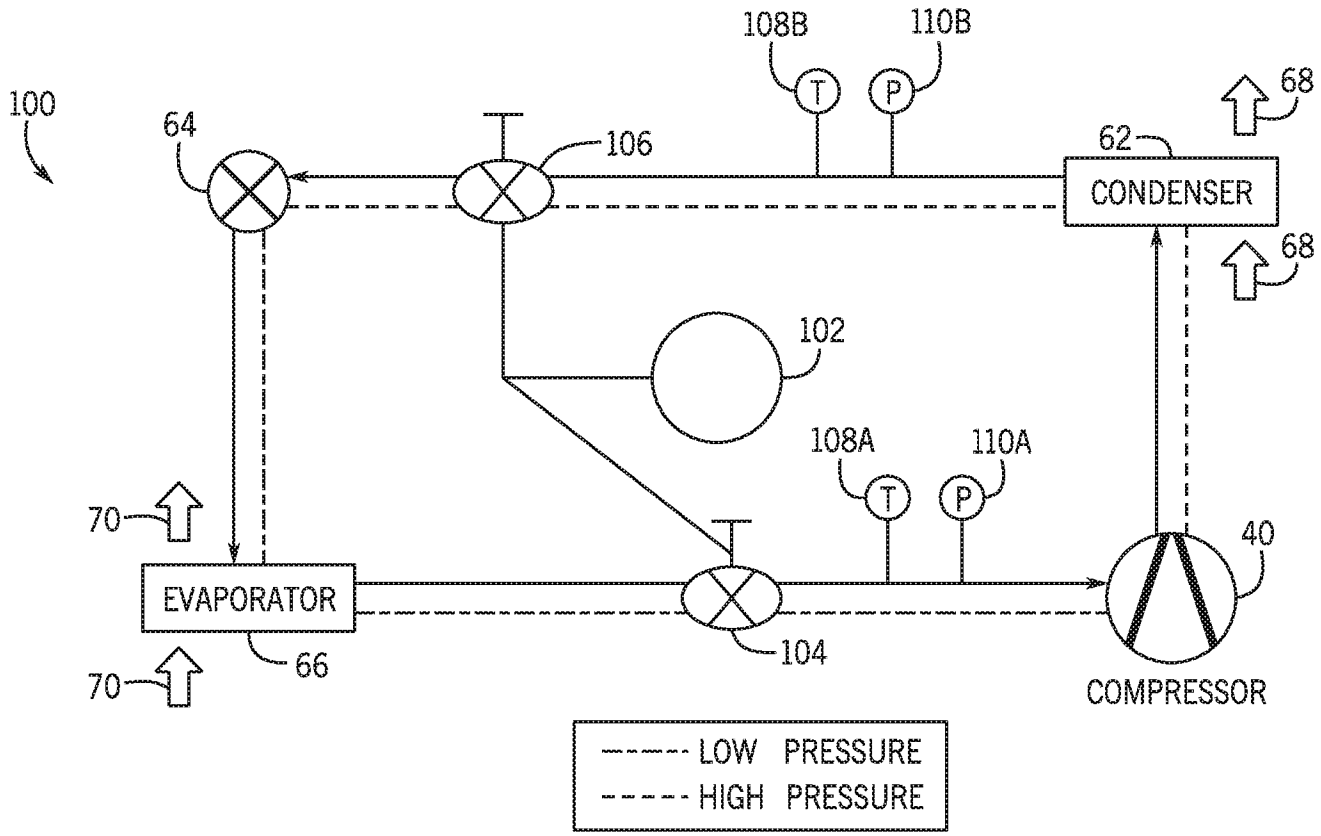
FIG. 5 is an example of the refrigerant loop of FIG. 4, in accordance with an embodiment of the present disclosure.

FIG. 5 is a schematic diagram of a refrigerant loop 100 that may be implemented with the above described embodiments. As with the above described embodiments, a refrigerant loop 100 may include a compressor 40, condenser 62, expansion device 64, and an evaporator 66 to facilitate heat transfer to and from the first air flow 68 and the second air flow 70. As described above, to facilitate optimal efficiency in a variety of scenarios, including different ambient temperatures and/or operating modes, it may be desirable to add or remove refrigerant from the refrigerant loop 100.

As such, a refrigerant tank 102 may be connected to the refrigerant loop 100 by way of a low-pressure valve 104 and/or a high-pressure valve 106 to add or remove refrigerant as desired. As stated above, it may be desirable to optimize the refrigerant charge (e.g., level) such that the refrigerant maintains a liquid state at certain points in the refrigerant loop 100 (e.g., before the expansion device 64) and maintains a gaseous state at other points in the refrigerant loop 100 (e.g., before the compressor 40).

To assist in determining the optimal refrigerant charge, superheat and subcool parameters may be determined and utilized. The current (e.g., actual) value of the superheat parameter may be given by the difference between a measured temperature (e.g., by temperature sensor 108A) of the refrigerant prior to the compressor 40 and the temperature (e.g., saturated vapor temperature) at which the refrigerant is expected to condense into liquid at the measured pressure (e.g., by pressure sensor 110A). In other words, the superheat parameter may correspond to a temperature buffer keeping the input refrigerant to the compressor 40 in a gaseous state. Additionally, the current (e.g., actual) value of the subcool parameter may be given by the difference between the temperature (e.g., saturated liquid temperature) at which the refrigerant is expected to vaporize or partially vaporize at the pressure measured before the expansion device 64 (e.g., by pressure sensor 110B) and the measured temperature of the refrigerant (e.g., by temperature sensor 108B).

As will be appreciated, the temperature sensors 108A and 108B and the pressure sensors 110A and 110B may be of any suitable type for measuring the temperature and pressure of the refrigerant. In some embodiments, a combined temperature/pressure sensor may be employed. Additionally, some embodiments may place the temperature sensors 108A and 108B and/or pressure sensors 110A and 110B at any suitable point in the refrigerant loop 100. For example, temperature sensor 108A and pressure sensor 110A may be located in the generally low-pressure portion of the refrigerant loop 100, whereas temperature sensor 108B and pressure sensor 110B may be located in the generally high-pressure portion of the refrigerant loop 100. As used herein, upstream and downstream may refer to a relative location/direction in the refrigerant loop 100 with reference to the flow of refrigerant through the refrigerant conduit 54.

At least in some instances, environmental conditions (e.g., temperature and/or humidity of the first air flow 68 and/or the second air flow 70) may affect the effectiveness of the heat exchangers (e.g., condenser 62 and evaporator 66). For example, if the first air flow 68 is relatively warm, less heat may be transferred from the compressed refrigerant compared to if the first air flow 68 was relatively cool. As such, different environmental conditions may, in turn, correspond to different calculated superheat and subcool parameter values at the same refrigerant charge level. Such environmental conditions may include a dry bulb temperature, a wet bulb temperature, a relative humidity, and/or any other suitable parameter for one or both of the first air flow 68 and the second air flow 70. As with the refrigerant temperature sensors 108A and 108B and pressure sensors 110A and 110B, the environmental conditions may be measured via any suitable sensors. For example, in one embodiment, an indoor temperature may be measured by a temperature sensor in the ductwork 14 prior to the evaporator 66 or condenser 62 if used as a heat pump, or at a control device 16, such as a thermostat.

In some embodiments, the control board 42 may monitor the current superheat and subcool parameters as well as the environmental conditions. The measured environmental conditions may be used to anticipate (e.g., predict) a value or range for the superheat parameter and/or the subcool parameter. For example, at an optimal refrigerant charge level, the control board 42 may use the measured environmental conditions to calculate an expected value or range of values for the superheat parameter and/or the subcool parameter. Furthermore, given the measured environmental conditions, expected values or ranges of values for the superheat and/or subcool parameters may be calculated at different charge levels (e.g., 85%, 100%, or 115% of optimal charge). In turn, these expected values or ranges for the superheat and/or subcool parameters may be compared to the current (e.g., as measured/calculated) superheat and/or subcool parameters to determine a refrigerant charge level. For example, if the current superheat and/or subcool parameter values correspond to an expected value or range designated as 85% of optimal charge level at the measured environmental conditions, an undercharge condition may be determined. As such, refrigerant may be added until the superheat and/or subcool parameters are approximately equal to the value(s) or fall into the range set for 100% of optimal charge level at the measured environmental conditions.

Put another way, for a given optimal refrigerant charge level, the measured environmental conditions may correspond to an expected value or range of values for the superheat and subcool parameters. If the current superheat parameter and/or the subcool parameter does not match the expected value, or is outside of an expected range for optimal charge, the control board 42 may designate that the refrigerant loop 100 is undercharged or overcharged.

Additionally or alternatively, a threshold level for the superheat and/or subcool parameters may be set such that, if the superheat and/or subcool parameter values drop below the threshold, refrigerant may be added or removed accordingly. Furthermore, if the control board 42 detects that an undercharge condition exists multiple times over a set time period, a leak condition may be noted. Such a leak condition may yield a notification to a user, for example, on a control device 16. The control board 42 may continue to supplement the refrigerant loop 100 with refrigerant from the refrigerant tank 102 until the HVAC unit 12 is serviced. Additionally or alternatively, the control board 42 may stop feeding the refrigerant loop 100 to reduce lost refrigerant. In some embodiments, such a setting may be set by a user, a technician set, or a manufacturer.

In response to a superheat and/or subcool parameter deviating from an expected value or being out of an expected range, the control board 42 may cause refrigerant to be added or removed from the refrigerant loop 100 by opening and closing the low-pressure valve 104 or the high-pressure valve 106 respectively. In some embodiments, flow of the refrigerant to or from the refrigerant tank 102 may be regulated by the low-pressure valve 104 or high-pressure valve 106 and/or by a flow restrictor or regulator. As discussed herein, opening, closing, and/or an open position of the low-pressure valve 104 or high-pressure valve 106 may refer to a partial or full opening of the low-pressure valve 104 or high-pressure valve 106. In some scenarios, after cycling on, the control board 42 may wait for the refrigerant loop 100 to stabilize (e.g., reach an approximately steady state condition) before determining if a change to the charge level is desired.

If additional refrigerant is desired, the control board 42 may instruct the low-pressure valve 104 to transition its valve position toward an open position to add refrigerant to the refrigerant loop 100 from the refrigerant tank 102. In some embodiments, the refrigerant may be added to the low-pressure portion of the refrigerant loop 100 while the HVAC unit 12 is running, which may facilitate improving operational reliability and/or reducing operational downtime. While the HVAC unit 12 is running, pressure in the refrigerant tank 102 may be greater than pressure at the low-pressure valve 104 in the refrigerant loop 100. In fact, in some embodiments, the pressure differential may enable refrigerant to be added via a passive flow of refrigerant from the refrigerant tank 102 into the refrigerant loop 100

Conversely, if removal of refrigerant from the refrigerant loop 100 is desired, the control board 42 may instruct the high-pressure valve 106 to transition its valve position toward an open position. In some embodiments, the refrigerant may be removed from the high-pressure portion of the refrigerant loop 100 while the HVAC unit 12 is running, which may facilitate improving operational reliability and/or reducing operational downtime. While the HVAC unit 12 is running, pressure in the refrigerant tank 102 may be less than pressure at the high-pressure valve 106 in the refrigerant loop 100. In fact, in some embodiments, the pressure differential may enable refrigerant to be removed via a passive flow of refrigerant from the refrigerant loop 100 into the refrigerant tank 102.

Additionally or alternatively, a pump may be used to facilitate flow of the refrigerant to or from the refrigerant tank 102. As such, the refrigerant tank 102 may then be maintained at any suitable pressure. Furthermore, in some embodiments, a pump may be used to facilitate the flow to or from the refrigerant tank 102 through a single valve (e.g., the low-pressure valve 104 or the high-pressure valve 106). As such, the refrigerant tank 102 may be linked to the refrigerant loop 100 via a single connection point.

As will be appreciated, monitoring of the environmental conditions, determining superheat parameters, determining subcool parameters, controlling valve position of the low-pressure valve 104, and/or controlling valve position of the high-pressure valve 106 may be done by the control board 42, a control device 16, or other circuitry of the HVAC unit 12. Additionally or alternatively, monitoring and control may be accomplished via standalone circuitry apart from that of the HVAC unit 12. In some embodiments, such a standalone system may be desirable in the case of a retrofit refrigerant charge regulator. As stated herein, control circuitry may be referred to as any suitable circuitry or collection of circuitry (e.g., the control board 42, a control device 16, and/or other circuitry of the HVAC unit 12) located in one or more locations for controlling one or more aspects of the embodiments discussed herein.

Figure 6:
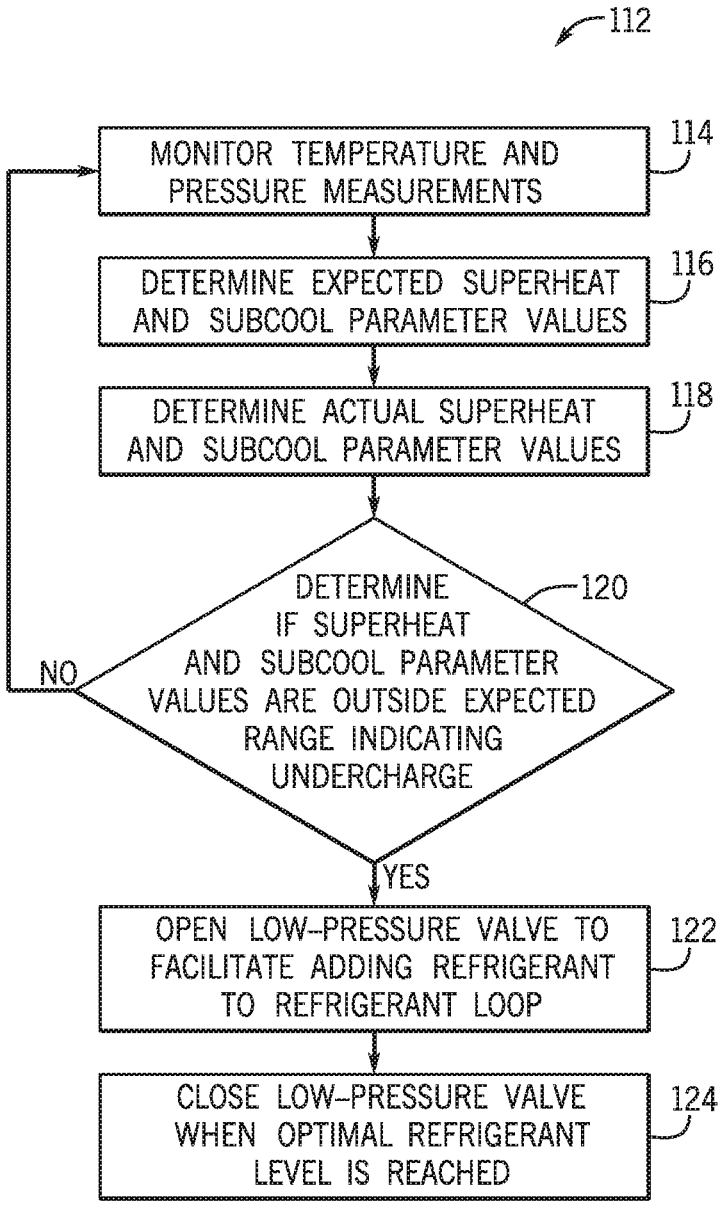
FIG. 6 is a flowchart of an example process for resolving a refrigerant undercharge condition, in accordance with an embodiment of the present disclosure.

To help further illustrate, an example of a process 112 for correcting an undercharge condition is described in FIG. 6. Generally, the process 112 includes monitoring temperature and pressure measurements (process block 114), determining expected superheat parameter and subcool parameter values and/or ranges (process block 116), determining actual superheat parameter and subcool parameter values (process block 118), and determining whether the actual superheat parameter and/or the subcool parameter values deviate from expected values or are outside expected (e.g., target) ranges (decision block 120). When the superheat parameter and/or the subcool parameter values are outside target ranges in a manner indicative of an undercharge condition, the process 112 includes opening a low-pressure value 104 to facilitate adding refrigerant to a refrigerant loop (process block 122) and closing the low-pressure valve when a target (e.g., optimal) refrigerant level is reached (process block 124).

Although the process 112 is described in a particular order, which represents a particular embodiment, it should be noted that the process 112 may be performed in any suitable order. Additionally, other embodiments of the process 112 may omit process blocks and/or include suitable additional process blocks. Moreover, in some embodiments, the process 112 may be implemented at least in part by executing instructions stored in a tangible, non-transitory, computer-readable medium, such as memory 80, using processing circuitry, such as microprocessor 78.

Accordingly, in some embodiments, a control board 42 may monitor the temperatures and pressure measurements (process block 114). In some embodiments, the temperatures and pressures may include the environmental conditions and/or the refrigerant loop conditions, for example, as measured from temperature sensors 108A and 108B and pressure sensors 110A and 110B. Based the measured temperatures and pressures, the control board 42 may determine the expected superheat parameter values and/or the expected subcool parameter values (process block 116). In one embodiment, an algorithm or look-up table may be utilized to relate measured environmental conditions to expected superheat and/or subcool parameter values at one or more refrigerant charge levels. Such an algorithm or look-up table may also include parameters for the mode of operation of the HVAC system 11 (e.g., air-conditioner or heat pump) size of the HVAC system 11 (e.g., tonnage), and/or other factors that may affect the optimal refrigerant charge level. Additionally, the control board 42 may determine the actual superheat parameter value and/or the actual subcool parameter value based at least in part on the measured temperatures and pressures (process block 118). In some embodiments, the monitoring of the temperatures and pressures as well as the determination of the expected and actual superheat and subcool parameter values may be accomplished continuously or periodically.

In any case, the control board 42 may then determine whether the actual superheat parameter value and/or the actual subcool parameter value differs from their respective expected values or are outside a target range in a manner indicative of an undercharge condition (decision block 120). If an undercharge condition is not identified, the control board 42 may return to monitoring the temperature and pressure measurements (process block 114). On the other hand, if an undercharge condition is identified, the control board 42 may open the low-pressure valve 104 to facilitate adding refrigerant to the refrigerant loop 100 (process block 122). When the optimal refrigerant level is reached (e.g., the superheat and subcool parameter values are within their target ranges or approximately equal to their respective expected values), the control board 42 may then close the low-pressure valve 104 to re-isolate the refrigerant tank 102 from the refrigerant loop 100 (process block 124). In this manner, a control board 42 may control operation of an HVAC system 11 to correct an undercharge condition, which, at least in some instances, may facilitate improving operational efficiency and/or operational reliability of the HVAC system 11.

Figure 7:
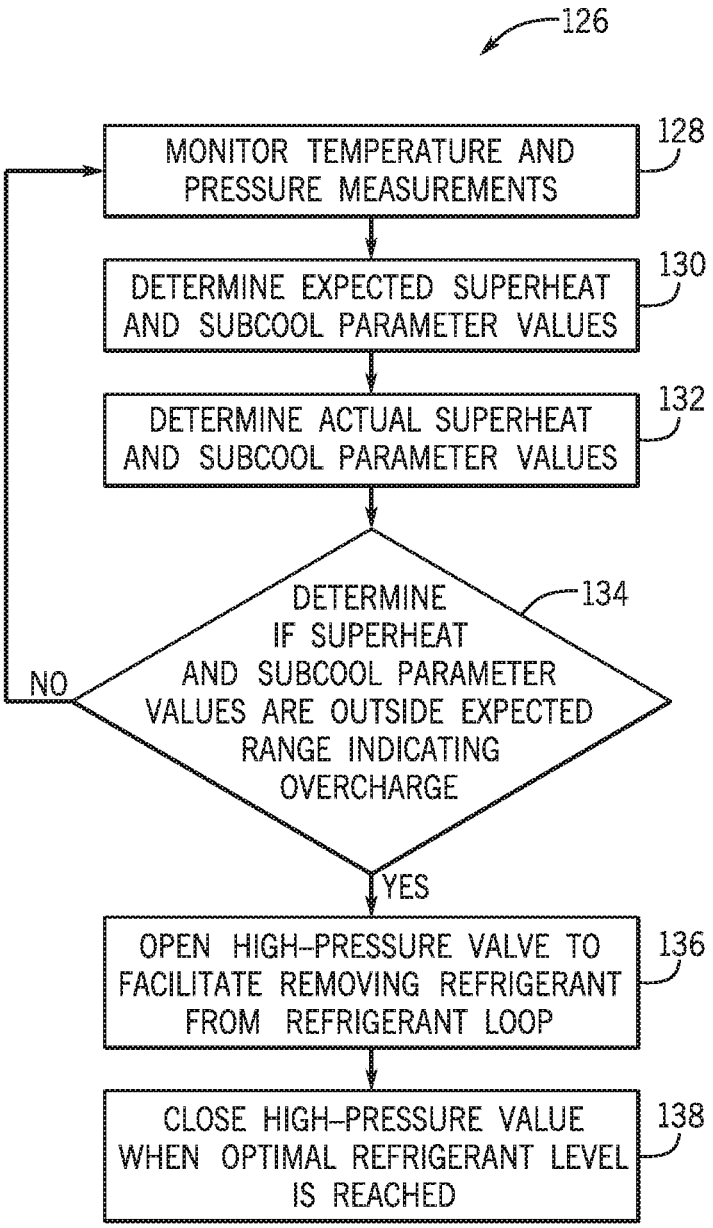
FIG. 7 is a flowchart of an example process for resolving a refrigerant overcharge condition, in accordance with an embodiment of the present disclosure.

Additionally or alternatively, the control board 42 may control correction of an overcharge condition, as described in the example process 126 of FIG. 7. Generally, the process 126 includes monitoring temperature and pressure measurements (process block 128), determining expected superheat parameter and subcool parameter values and/or ranges (process block 130), determining actual superheat parameter and subcool parameter values (process block 132), and determining whether the actual superheat parameter and/or the subcool parameter values are outside expected (e.g., target) ranges or deviate from their respective expected values (decision block 134). When the superheat parameter and/or the subcool parameter values are outside target ranges or deviate from their respective expected values in a manner indicative of an overcharge condition, the process 126 includes opening a high-pressure value to facilitate removing refrigerant from a refrigerant loop (process block 136) and closing the high-pressure valve when a target (e.g., optimal) refrigerant level is reached (process block 138).

Although the process 126 is described in a particular order, which represents a particular embodiment, it should be noted that the process 126 may be performed in any suitable order. Additionally, other embodiments of the process 126 may omit process blocks and/or include suitable additional process blocks. Moreover, in some embodiments, the process 126 may be implemented at least in part by executing instructions stored in a tangible, non-transitory, computer-readable medium, such as memory 80, using processing circuitry, such as microprocessor 78.

Accordingly, in some embodiments, a control board 42 may monitor the temperatures and pressure measurements (process block 128). In some embodiments, the temperatures and pressures may include the environmental conditions and/or the refrigerant loop conditions, for example, as measured from temperature sensors 108A and 108B and pressure sensors 110A and 110B. Based the measured temperatures and pressures, the control board 42 may determine the expected superheat parameter and/or the expected subcool parameter values and/or ranges (process block 130). In one embodiment, an algorithm or look-up table may be utilized to relate measured environmental conditions to expected superheat and/or subcool parameter values at one or more refrigerant charge levels. Additionally, the control board 42 may determine the actual superheat parameter value and/or the actual subcool parameter value based at least in part on the measured temperatures and pressures (process block 132). In some embodiments, the monitoring of the temperatures and pressures as well as the determination of the expected and actual superheat and subcool parameter values may be accomplished continuously or periodically.

In any case, the control board 42 may then determine whether the actual superheat parameter value and/or the actual subcool parameter value is outside a target range or deviates from an expected value in a manner indicative of an overcharge condition (decision block 134). If an overcharge condition is not identified, the control board 42 may return to monitoring the temperature and pressure measurements (process block 128). On the other hand, if an overcharge condition is indicated, the control board 42 may open the high-pressure valve 106 to facilitate removing refrigerant from the refrigerant loop 100 (process block 136). When the optimal refrigerant level is reached (e.g., the superheat and subcool parameter values are approximately equal to their respective expected values and/or fall within their respective target ranges), the control board 42 may then close the high-pressure valve 106 to re-isolate the refrigerant tank 102 from the refrigerant loop 100 (process block 138). In this manner, a control board 42 may control operation of an HVAC system 11 to correct an overcharge condition, which, at least in some instances, may facilitate improving operational efficiency and/or operational reliability of the HVAC system 11.

In some embodiments, the control board 42 may identify an undercharge condition or an overcharge condition separately. For example, the control board 42 may identify and correct an undercharge condition without concern of an overcharge condition or vice versa. In other embodiments, the control board 42 may simultaneously determine whether an undercharge condition is present and whether an overcharge condition is present.

Figure 8:
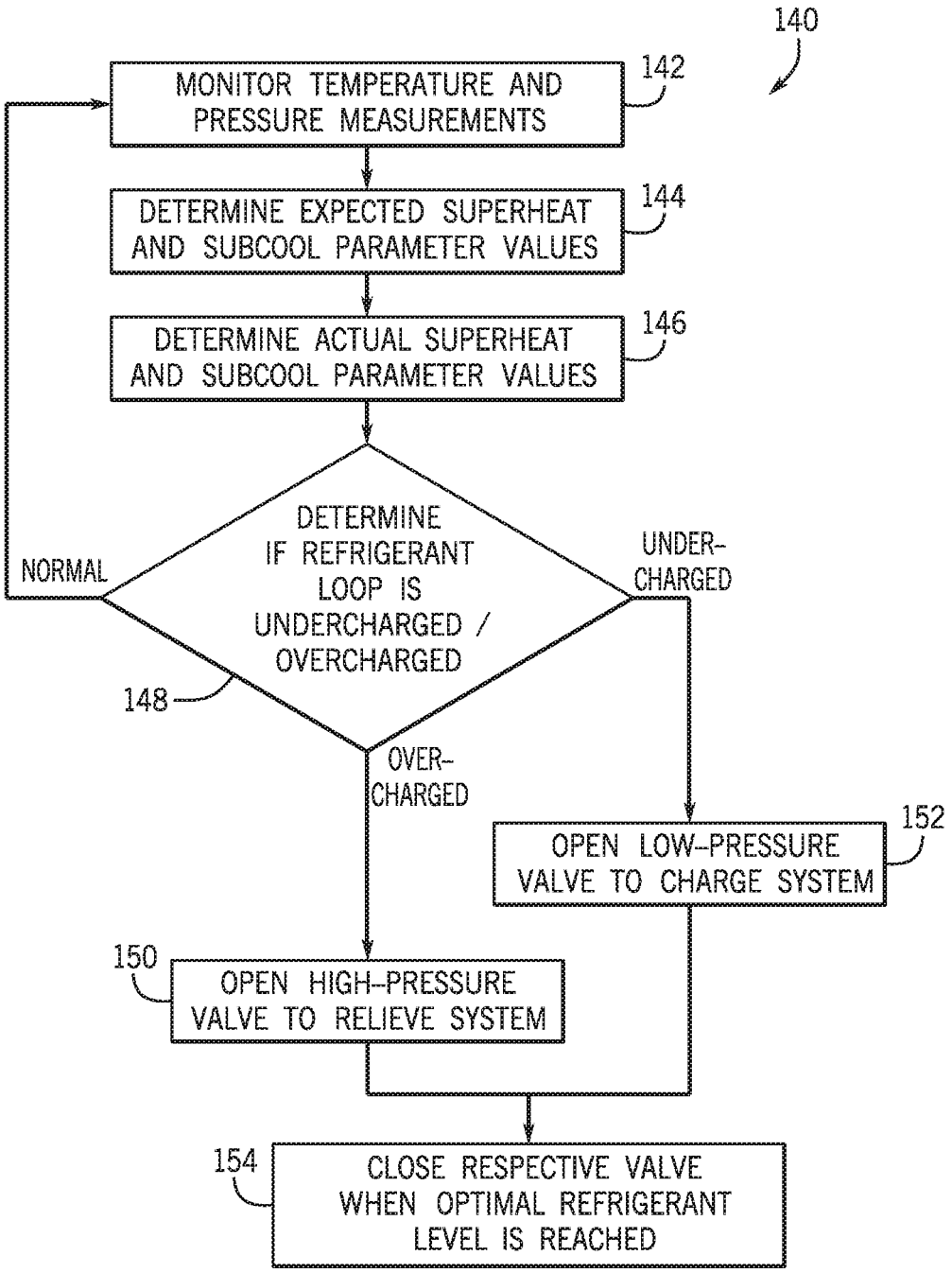
FIG. 8 is a flowchart of an example process for regulating a refrigerant charge level, in accordance with an embodiment of the present disclosure.

To help illustrate, an example of a process 140 for correct overcharge conditions and/or undercharge conditions is described in FIG. 8. Generally, the process 140 includes monitoring temperature and pressure measurements (process block 142), determining expected superheat parameter and subcool parameter values (process block 144), determining actual superheat parameter and subcool parameter values (process block 146), and determining whether a refrigerant loop 100 is normal, undercharged, or overcharged (decision block 148). Additionally, the process 140 includes opening a high-pressure valve 106 to relieve the refrigerant loop when the refrigerant loop 100 is overcharged (process block 150), opening a low-pressure valve 104 to charge the refrigerant loop 100 when the refrigerant loop 100 is undercharged (process block 152), and closing a respective valve when a target (e.g., optimal) refrigerant level is reached (process block 154).

Although the process 140 is described in a particular order, which represents a particular embodiment, it should be noted that the process 140 may be performed in any suitable order. Additionally, other embodiments of the process 140 may omit process blocks and/or include suitable additional process blocks. Moreover, in some embodiments, the process 140 may be implemented at least in part by executing instructions stored in a tangible, non-transitory, computer-readable medium, such as memory 80, using processing circuitry, such as microprocessor 78.

Accordingly, in some embodiments, a control board 42 may monitor the temperatures and pressure measurements (process block 142). In some embodiments, the temperatures and pressures may include the environmental conditions and/or the refrigerant loop conditions, for example, as measured from temperature sensors 108A and 108B and pressure sensors 110A and 110B. Based the measured temperatures and pressures, the control board 42 may determine the expected superheat parameter value and/or the expected subcool parameter value (process block 144). In one embodiment, an algorithm or look-up table may be utilized to relate measured environmental conditions to expected superheat and/or subcool parameter values at one or more refrigerant charge levels (e.g., 80%, 90%, 100%, 110%, or 120% of optimal charge level). Additionally, the control board 42 may determine the actual superheat parameter value and/or the actual subcool parameter value based at least in part on the measured temperatures and pressures (process block 146). In some embodiments, the monitoring of the temperatures and pressures as well as the determination of the expected and actual superheat and subcool parameter values may be accomplished continuously or periodically.

The control board 42 may then examine the actual superheat and/or subcool parameters values in relation to the expected values/ranges and indicate a normal, undercharge, or overcharged condition (decision block 148). If a normal condition is identified (e.g., the actual superheat and/or subcool parameter values are approximately equal to their respective expected values and/or fall into their respective expected ranges), the control board 42 may return to monitoring the temperature and pressure measurements (process block 142). If an overcharge condition is indicated, the control board 42 may open the high-pressure valve 106 to relieve the refrigerant loop 100 of excess refrigerant (process block 150). If an undercharge condition is indicated, the control board 42 may open the low-pressure valve 104 to charge the refrigerant loop 100 by adding refrigerant (process block 152). In one embodiment, an algorithm or look-up table may be utilized to relate measured environmental conditions to expected superheat and/or subcool parameter values at one or more refrigerant charge levels to determine if the actual superheat and/or subcool parameter values correspond to an undercharge or overcharge condition. When the optimal refrigerant level is reached (e.g., the superheat and/or subcool parameter values are within an optimal range), the control board 42 may then close the respective low-pressure valve 104 or high-pressure valve 106 to re-isolate the refrigerant tank 102 from the refrigerant loop 100 (process block 154).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A refrigerant circuit comprising:
a conduit configured to circulate a refrigerant;
a first valve fluidly coupled to the conduit, the first valve having an open position of the first valve and a closed position of the first valve;
a second valve fluidly coupled to the conduit, the second valve having an open position of the second valve and a closed position of the second valve;
a sensor configured to measure parameters of the refrigerant in the conduit;
a tank fluidly coupled to the conduit; and
control circuitry communicatively coupled to the sensor, the first valve, and the second valve, wherein the control circuitry is configured to:
detect whether an undercharge condition or an overcharge condition is present in the refrigerant circuit based on the parameters of the refrigerant measured by the sensor;
instruct the first valve to the open position when the undercharge condition is detected to facilitate flowing refrigerant from the tank into the refrigerant circuit; and
instruct the second valve to the open position when the overcharge condition is detected to facilitate flowing refrigerant from the conduit into the tank.

2. The refrigerant circuit of claim 1, further comprising:
a compressor configured to compress the refrigerant to a higher pressure; and
an expansion device configured to expand the refrigerant to a lower pressure, wherein:
the first valve is fluidly coupled downstream relative to the expansion device and upstream relative to the compressor; and
the second valve is fluidly coupled downstream relative to the compressor and upstream relative to the expansion device.

3. The refrigerant circuit of claim 2, further comprising:
a condenser configured to condense the refrigerant; and
an evaporator configured to vaporize the refrigerant, wherein:
the first valve is fluidly coupled downstream relative to the evaporator and upstream relative to the compressor; and
the second valve is fluidly coupled downstream relative to the condenser and upstream relative to the expansion device.

4. The refrigerant circuit of claim 1, wherein the sensor is a first sensor configured to measure temperature of the refrigerant at a first point in the refrigerant circuit, the refrigerant circuit further comprising:
a second sensor configured to measure pressure of the refrigerant at the first point in the refrigerant circuit;
a third sensor configured to measure temperature of the refrigerant at a second point in the refrigerant circuit different from the first point; and
a fourth sensor configured to measure pressure of the refrigerant at the second point in the refrigerant circuit.

5. The refrigerant circuit of claim 1, wherein:
the sensor is a first sensor, and the refrigerant circuit comprises a second sensor;
the first sensor and the second sensor are configured to measure temperature and pressure, respectively, of liquid refrigerant in the conduit; and
the control circuitry is configured to:
determine a saturated liquid temperature based at least in part on the pressure of the liquid refrigerant measured by the second sensor;
determine a subcool parameter based at least in part on a difference between the saturated liquid temperature and the temperature of the liquid refrigerant measured by the first sensor;
determine a target subcool range based at least in part on environmental conditions of the refrigerant circuit, wherein the target subcool range corresponds to an optimal refrigerant charge level; and
detect that the undercharge condition or the overcharge condition is present when the subcool parameter falls outside the target subcool range.

6. The refrigerant circuit of claim 1, wherein:
the sensor is a first sensor, and the refrigerant circuit comprises a second sensor;
the first sensor and the second sensor are configured to measure temperature and pressure, respectively, of refrigerant vapor in the conduit; and
the control circuitry is configured to:
determine a saturated vapor temperature based at least in part on the pressure of the refrigerant vapor measured by the second sensor;
determine a superheat parameter based at least in part on a difference between the temperature of the refrigerant vapor measured by the first sensor and the saturated vapor temperature;
determine a target superheat range based at least in part on environmental conditions of the refrigerant circuit; and
detect that the undercharge condition or the overcharge condition is present when the superheat parameter falls outside the target superheat range.

7. The refrigerant circuit of claim 1, comprising a pump fluidly coupled to the tank, wherein the control circuitry is configured to:
instruct the pump to pump the refrigerant from the conduit into the tank while the second valve is in the open position of the second valve;
instruct the pump to pump the refrigerant from the tank into the conduit while the first valve is in the open position of the first valve; or
both.

8. The refrigerant circuit of claim 1, wherein the control circuitry is configured to:
determine a target refrigerant charge level based at least in part on environmental conditions of the refrigerant circuit; and instruct the first valve to transition from the open position of the first valve to the closed position of the first valve when the target refrigerant charge level is reached.

9. The refrigerant circuit of claim 1, wherein the control circuitry is configured to:

determine a target refrigerant charge level based at least in part on environmental conditions of the refrigerant circuit; and instruct the second valve to transition from the open position of the second valve to the closed position of the second valve when the target refrigerant charge level is reached.

10. The refrigerant circuit of claim 1, wherein the control circuitry is configured to determine a target refrigerant charge level based at least in part on environmental conditions of the refrigerant circuit, wherein the environmental conditions comprise a dry bulb temperature, a wet bulb temperature, a relative humidity, or a combination thereof of an air flow.

11. A system, comprising:

a refrigerant circuit configured to circulate a refrigerant;

a first valve fluidly coupled to the refrigerant circuit;

a second valve fluidly coupled to the refrigerant circuit;

a compressor configured to compress the refrigerant to generate a high-pressure portion of the refrigerant circuit;

an expansion device configured to expand the refrigerant to generate a low-pressure portion, wherein the first valve is disposed at the low-pressure portion of the refrigerant circuit;

a sensor configured to measure parameters of the refrigerant in the refrigerant circuit;

a tank fluidly coupled to the refrigerant circuit via the first valve, the second valve, or both; and control circuitry communicatively coupled to the sensor, the first valve, and the second valve, wherein the control circuitry is configured to:

detect whether an undercharge condition or an overcharge condition is present in the refrigerant circuit based on the measured parameters;

in response to detecting the undercharge condition, instruct the first valve to transition to an open position of the first valve to facilitate flow of the refrigerant from the tank to the refrigerant circuit; and in response to detecting the overcharge condition, instruct the second valve to transition to an open position of the second valve to facilitate flow of the refrigerant from the refrigerant circuit to the tank.

12. The system of claim 11, wherein the second valve is disposed at the high-pressure portion of the refrigerant circuit.

13. A system, comprising:

a refrigerant circuit configured to circulate a refrigerant;

a first valve fluidly coupled to the refrigerant circuit;

a second valve fluidly coupled to the refrigerant circuit;

a compressor configured to facilitate circulation of the refrigerant through the refrigerant circuit;

a sensor configured to measure parameters of the refrigerant in the refrigerant circuit;

a tank fluidly coupled to the refrigerant circuit via the first valve, the second valve, or both;

control circuitry communicatively coupled to the sensor, the first valve, and the second valve, wherein the control circuitry is configured to:

detect whether an undercharge condition or an overcharge condition is present in the refrigerant circuit based on the measured parameters;

in response to detecting the undercharge condition, instruct the first valve to transition to an open position of the first valve to facilitate flow of the refrigerant from the tank to the refrigerant circuit; and in response to detecting the overcharge condition, instruct the second valve to transition to an open position of the second valve to facilitate flow of the refrigerant from the refrigerant circuit to the tank; and a pump configured to pump the refrigerant from the refrigerant circuit into the tank while the second valve is in the open position of the second valve.

14. The system of claim 13, wherein the pump is configured to pump the refrigerant from the tank into the refrigerant circuit while the first valve is in the open position of the first valve.

* * * * *